US005337958A

United States Patent [19]

Hennessy et al.

[11] Patent Number: 5,337,958

[45] Date of Patent: Aug. 16, 1994

[54] SCREW-IN TYPE SPRAY NOZZLE AND METHOD OF ASSEMBLY

[75] Inventors: Timothy H. Hennessy, Aurora; Patrick M. Maney, Batavia, both of Ill.

[73] Assignee: Spraying Systems Co., Wheaton, Ill.

[21] Appl. No.: 71,073

[22] Filed: Jun. 2, 1993

[51] Int. Cl.[5] ..... B05B 1/04; B05B 15/06

[52] U.S. Cl. ..... 239/71; 239/599; 239/600

[58] Field of Search ..... 239/600, 599, 550, 1, 239/71; 411/402, 409, 378

[56] References Cited

U.S. PATENT DOCUMENTS

| | | | |
|---|---|---|---|
| 4,915,560 | 4/1990 | Peterson et al. | 411/378 |
| 4,988,043 | 1/1991 | Lechler | 239/600 |
| 5,060,869 | 10/1991 | Bekius | 239/600 |

FOREIGN PATENT DOCUMENTS

| | | | |
|---|---|---|---|
| 1398771 | 4/1965 | France | 411/402 |
| 72539 | 11/1916 | Switzerland | 411/378 |
| 7917 | of 1907 | United Kingdom | 239/550 |
| 1229443 | 4/1971 | United Kingdom | 411/402 |

*Primary Examiner*—Karen B. Merritt

*Attorney, Agent, or Firm*—Leydig, Voit & Mayer, Ltd.

[57] ABSTRACT

A spray nozzle and method of assembly onto the threaded end of a supply line or like by use of a conventional wrench. The spray nozzle has an elongated body formed with an axial flow passageway, a threaded upstream end, a wrench engaging downstream end, and a radial locating and support flange intermediate its upstream and downstream ends for supporting the nozzle on the wrench with the downstream end in operative relation to the gripping elements of the wrench and with the threaded upstream end extending outwardly of the wrench for positioning into threaded engagement with the threaded supply line by use of the wrench. The spray nozzle has an elongated discharge orifice and the support flange has flats formed parallel to the long axis of the discharge orifice to aid in orientating the nozzle.

8 Claims, 1 Drawing Sheet

SCREW-IN TYPE SPRAY NOZZLE AND METHOD OF ASSEMBLY

FIELD OF THE INVENTION

The present invention relates to an improved screw-in type spray nozzle and to a method of assembling such nozzle in the threaded outlet of a supply line or nozzle body.

BACKGROUND OF THE INVENTION

Screw in type spray nozzles commonly are formed with a threaded upstream end which enable the nozzle to be screwed into the threaded outlet or fitting of a supply line or nozzle body. The downstream end of the nozzle may be formed with flats to enable a wrench to engage and turn the nozzle into tight threaded engagement with the fitting or outlet. Socket wrenches frequently are utilized for installing such threaded nozzles, and it is common practice to position the downstream end of the tip into the socket and then use the wrench to position the threaded end of the nozzle in proper relation with the threaded fitting and to rotate the spray tip into engagement therewith.

If the socket of the wrench is particularly long, or the spray nozzle short, the nozzle can drop completely into the socket, without any portion of the threaded end being exposed to engage the threaded fitting. Such problem is particularly troublesome when the nozzle is being installed in an overhead fitting for downward spraying. In such case, the spray nozzle must be removed from the socket, started into engagement with the threaded fitting by hand, and then wrench tightened. Such procedure can be both cumbersome and time consuming, particularly when the nozzle mountings are inconveniently located or a large number of nozzles must be installed. Such spray nozzles also frequently do not lend themselves to easy use with other forms of wrenches.

OBJECTS AND SUMMARY OF THE INVENTION

It is an object of the present invention to provide a spray nozzle which lends itself to easier and more reliable mounting in the threaded outlet or fitting of a supply line or nozzle body.

Another object is to provide a spray nozzle as characterized above which facilitates reliable engagement of externally exposed flats on the downstream end thereof by gripping elements of a wrench and which permits the wrench to both position the spray nozzle into operative relation to a threaded fitting and to screw the nozzle into tight engagement therewith.

A further object is to provide a spray nozzle of the above kind which can be used in the foregoing manner with a socket, box, or other commonly available forms of wrenches.

Still another object is to provide a method of installing a spray nozzle of the foregoing type in a threaded engagement with a fitting or the like.

Other objects and advantages of the invention will become apparent upon reading the following detailed description and upon reference to the drawings, in which:

DESCRIPTION OF THE PREFERRED EMBODIMENT

Figure 1:
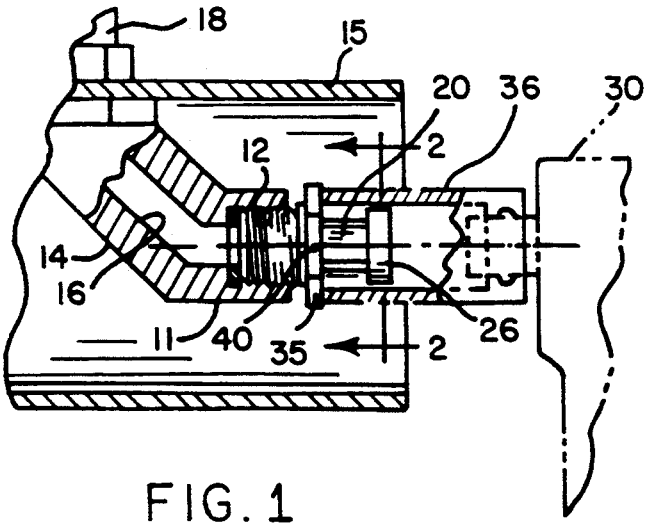
FIG. 1 is a fragmentary section depicting installation of a spray nozzle in accordance with the invention into the discharge end of a liquid supply line.
Figure 2:
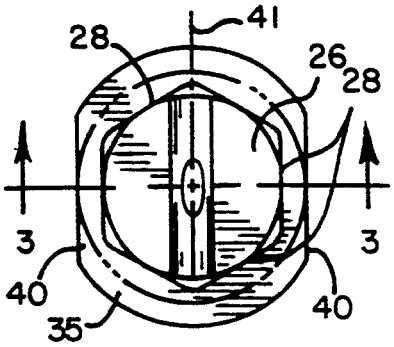
FIG. 2 is an enlarged plane view of a downstream end of the spray nozzle shown in FIG. 1, taking the plane of line 2—2 in FIG. 1.
Figure 3:
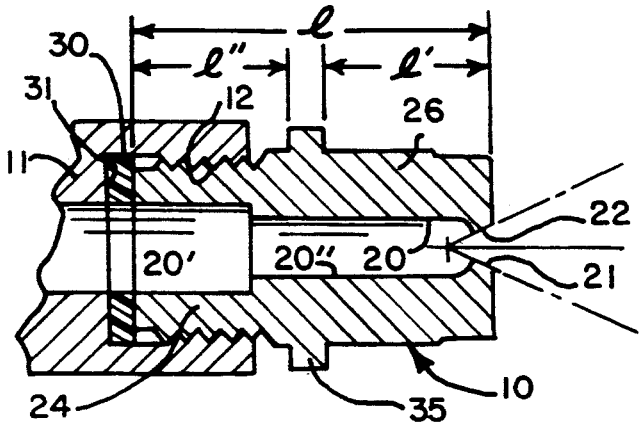
FIG. 3 is a horizontal section of the mounted spray nozzle taken in the plane of line 3—3 in FIG. 2.
Figure 4:
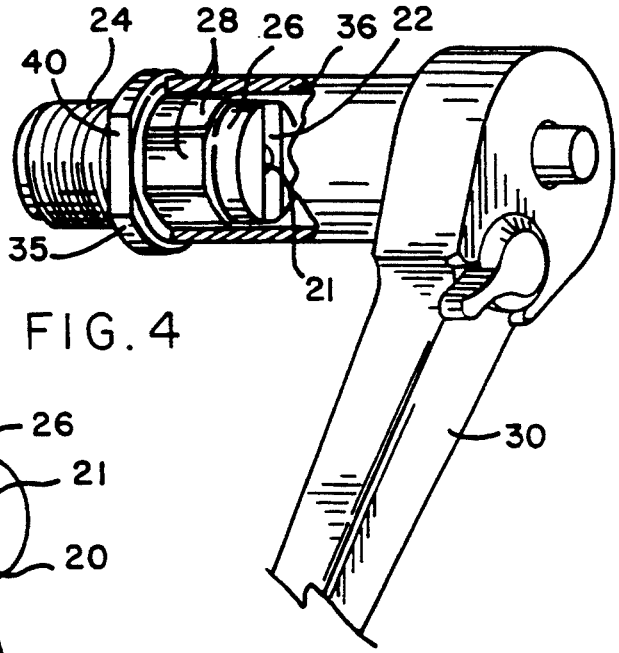
FIG. 4 is a perspective illustrating the manner in which the spray nozzle may be supported in a conventional socket wrench during installation.

Referring now more particularly to FIG. 3 of the drawings, there is shown an illustrative spray nozzle 10 embodying the present invention mounted in a supply line 11 have an internally threaded end 12. The supply line 11 in this case is in the form of a nozzle support member or body 14 having its threaded discharge end 12 in coaxial, slightly recessed relation to the discharge end of a tubular conduit 15. The support member 14 is mounted in depending relation from the top of an internal cylindrical wall of the conduit 15 and is formed with a flow passage 16 through which a supply liquid is directed from an outside source 18. It will be understood that as used herein threaded supply line is intended to include a supply line 11 as illustrated having a threaded discharge end, supply lines having a threaded fitting at the discharge end, as well as nozzle bodies and housings having threaded discharge ends or fittings.

The illustrated spray nozzle 10, which may be made of plastic or other material of suitable strength and durability, has an elongated generally cylindrical body formed with an axial flow passage 20 communicating with the supply line flow passage 16. The nozzle flow passage 20 in this case has an enlarged diameter upstream portion 20' that communicates with an elongated smaller diameter passage 20'', which in turn communicates with a discharge orifice 21 at a downstream end of the nozzle 10. The discharge orifice 21 has an elongated shape defined by a V-notch 22 formed in the end of the spray nozzle 10 in intersecting relation to the passage 20'' for generating a flat spray pattern of the discharging liquid. For securing the nozzle 10 to the discharge end of the supply line 11, the nozzle 10 has an upstream end portion 24 formed with external threads adapted for threaded engagement with the internally threaded end 12 of the supply line 11. To facilitate secure threaded engagement of the nozzle 10 with the supply line 11, the nozzle 10 has a downstream end portion 26 formed with a plurality of flats 28, in this instance in hex form, to facilitate engagement by the gripping elements of a wrench, such as a conventional socket wrench 30. In the illustrated embodiment, a sealing gasket 31 is interposed between an upstream end of the nozzle 10 and a shoulder 32 defined by a counterbore within the supply line 11. It will be understood that in lieu of the sealing gasket 31 the upstream end portion 24 of the nozzle 10 may be formed with tapered sealing threads to eliminate the necessity for the end gasket.

In accordance with the invention, the spray nozzle has a radially extending locating and support flange intermediate the threaded upstream end portion thereof and the flats of the downstream end portion for positioning onto a wrench for locating the nozzle flats in proper relation to the gripping elements of the wrench and for facilitating positioning of the threaded upstream end portion into operative relation to the threaded supply line. To this end, in the illustrated embodiment, the spray nozzle 10 has an integrally formed radial flange 35 located centrally between its opposite ends, separating the upstream threaded end portion 24 from the downstream wrench engaging end portion 26. The flange 35 has an effective diameter that is greater than the diameter of the socket 36 so that when the downstream end portion 26 is positioned within the socket 36 the nozzle 10 is supported on the end of the socket by the flange 35, thereby automatically positioning the flats 28 of the downstream end portion 26 in operative relation to the socket gripping elements and causing the upstream threaded end portion 24 to be in outwardly extending relation to the socket 36 for positioning into engagement with the threaded supply line 11. A typical nozzle 10 may have a length 1 of about one inch with the downstream end portion 26 having a length 1′ of about one-half inch and the upstream end portion having a length 1″ of about 0.435 inches.

Figure 5:
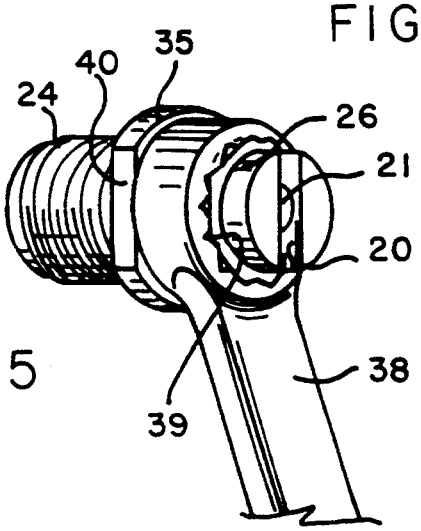
FIG. 5 is a perspective depicting the manner in which the spray nozzle may be supported in a conventional box wrench during installation, While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover–all modifications, alternative constructions and equivalents falling within the spirit and scope of the invention.

It will be appreciated that the downstream end portion 26 of the nozzle 10 may be hand positioned into the socket 36 with the radial flange 35 supporting the nozzle 10 on the end of the socket 36 in proper position for installation. The wrench 30 may then be used to position the outwardly extending threaded end portion 24 of the nozzle 10 into proper relation to the threaded end 12 of the discharge line 11 and then rotate the nozzle 10 into secure engagement therewith. While the nozzle 10 is particularly adapted for use with a socket wrench 30, as depicted in FIGS. 1–4, it will be appreciated that the nozzle 10 may be used with other forms of wrenches, such as a box wrench 38 shown in FIG. 5. In that instance, the downstream end portion 26 of the nozzle 10 is positioned into the box or other aperture 39 defined by the wrench gripping elements, with the nozzle flange 35 supporting and locating the nozzle 10 on the wrench with the gripping elements of the wrench 38 in operative relation to the nozzle flats 28 and with the upstream threaded end portion 24 of the nozzle extending outwardly therefrom for easy positioning into engagement with a threaded supply line 11. It will be further appreciated that, regardless of the type of wrench used, the nozzle 10 may be installed in overhead supply lines for downward spraying without the nozzle dropping through or into the socket of the wrench to the point that the threaded end of the nozzle is inaccessible for engagement with the supply line.

In keeping with the invention, the locating and support flange 35 of the spray nozzle 10 is formed with flats 40 that are in predetermined relation to the long axis 41 of the elongated discharge orifice 21 of the nozzle to facilitate mounting of the nozzle with the discharge orifice 21 in predetermined orientation for desired spraying. The flats 40, which in this case are parallel to the long axis 41 of the nozzle discharge orifice 21, particularly facilitate mounting of the nozzle 10 with the spray orifice in predetermined orientation in installations where the discharge orifice cannot easily be observed, or because of its relatively small size, cannot be accurately oriented.

From the foregoing, it can be seen that the spray nozzle of the present invention lends itself to easy and reliable mounting in the threaded outlets or fittings of liquid supply lines or nozzle bodies by use of conventional wrenches. The integrally formed locating and support flange facilitates positioning of the nozzle onto the wrench with the downstream end thereof in operative relation to the gripping elements of the wrench and with the threaded upstream end extending outwardly thereof for easy positioning and engagement with the threaded supply line.

What is claimed is:

1. A spray nozzle for mounting in a threaded discharge end of a liquid supply line by use of a wrench having spaced apart gripping elements comprising an elongated nozzle body having a flow passage communicating between upstream and downstream ends thereof for receiving liquid from the supply line on which the nozzle is mounted, means defining a discharge orifice having an elongated configuration with a long axis oriented transversely across an end of said nozzle body at a downstream end of said flow passage, said body having a threaded upstream end portion for threaded engagement with said supply line and a downstream end portion for engagement by the gripping elements of said wrench, said nozzle body having an integrally formed, radially extending, locating and support flange intermediate its upstream and downstream end portions for supporting the nozzle body on said wrench with the downstream end portion thereof in operative relation to the wrench gripping elements and with the threaded upstream end portion extending outwardly of the wrench for positioning into engagement with the threaded discharge end of said supply line by use of said wrench, and said radial locating and support flange being formed with flats oriented in predetermined parallel relation to the long axis of said elongated discharge orifice for permitting mounting of said nozzle in engaged relation with said supply line by use of said wrench with said discharge orifice in predetermined orientation with respect to the supply line without reference to the discharge orifice.

2. The spray nozzle of claim 1 in which said locating and support 6 flange is disposed approximately midway along the elongated length of said nozzle body.

3. The spray nozzle of claim 2 in which said downstream end portion extends about one-half inch downstream of said locating and support flange.

4. The spray nozzle of claim 1 in which said discharge orifice defining means is a V-notch formed in a downstream end of said nozzle body in intersecting relation to said flow passage.

5. The spray nozzle of claim 1 in which said upstream end portion is formed with external threads.

6. A method of assembling onto a threaded discharge end of a liquid supply line a spray nozzle having a threaded upstream end portion, a downstream gripping end portion formed with a discharge orifice having an elongated configuration with a long axis oriented transversely across a downstream end thereof, and a locating and support flange extending radially outwardly at a location between said upstream and downstream end portions and being formed with flats oriented in predetermined parallel relation to the long axis of said elongated discharge orifice comprising the steps of hand positioning the nozzle onto a wrench such that the nozzle is supported on the wrench by said locating and support flange with the downstream end portion disposed in operative relation to gripping elements of the wrench and with the upstream threaded end portion extending outwardly of the wrench, positioning the wrench to locate the upstream end portion of the nozzle into position for engaging the threaded discharge end of the supply line, turning the nozzle into threaded engagement with the discharge end of the supply line by turning the wrench, and orienting the discharge orifice of the nozzle into predetermined orientation with respect to the supply line by turning said wrench to orient said flats.

7. The method of claim 5 including hand positioning the nozzle locating and support flange onto the end of a socket wrench with the downstream end portion disposed within a socket of the wrench so that the discharge orifice is located within the socket and is not accessible to viewing.

8. The method of claim 6 including hand positioning the locating and support flange of the nozzle onto the end of a box wrench with the downstream end portion of the nozzle disposed within gripping elements of the wrench.

* * * * *